US011559752B2

(12) United States Patent
Han

(10) Patent No.: US 11,559,752 B2
(45) Date of Patent: Jan. 24, 2023

(54) TOY VEHICLE PLAYSET WITH MANUALLY OPERABLE CAR FEEDER

(71) Applicant: Mattel, Inc., El Segundo, CA (US)

(72) Inventor: Eric Han, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 513 days.

(21) Appl. No.: 16/722,611

(22) Filed: Dec. 20, 2019

(65) Prior Publication Data

US 2020/0206643 A1 Jul. 2, 2020

Related U.S. Application Data

(60) Provisional application No. 62/784,876, filed on Dec. 26, 2018.

(51) Int. Cl.
*A63H 18/02* (2006.01)
*A63H 18/06* (2006.01)
*A63H 18/14* (2006.01)

(52) U.S. Cl.
CPC ..... *A63H 18/028* (2013.01); *A63H 18/025* (2013.01); *A63H 18/14* (2013.01)

(58) Field of Classification Search
CPC ..... A63H 18/00; A63H 18/02; A63H 18/028; A63H 18/06
USPC ..... 446/444, 487; 104/53, 54, 55, 79; 463/58; 238/10 R, 10 E
See application file for complete search history.

(56) References Cited

U.S. PATENT DOCUMENTS 1,715,891 A * 6/1929 Beck ..... A63H 18/06 104/79
3,204,574 A * 9/1965 Frisbie ..... A63H 18/02 104/54
3,359,920 A * 12/1967 Iammatteo ..... A63H 18/028 238/10 F
3,402,503 A * 9/1968 Marvin ..... A63H 18/005 238/10 F
3,775,897 A * 12/1973 Soulakis ..... A63H 18/02 238/10 R
3,858,875 A * 1/1975 Nemeth ..... A63H 18/02 104/54
4,094,089 A * 6/1978 Sano ..... A63H 18/06 446/444
4,185,409 A * 1/1980 Cheng ..... A63H 18/028 238/10 F (Continued)

*Primary Examiner* — Alexander R Niconovich
(74) *Attorney, Agent, or Firm* — Whiteford, Taylor & Preston, LLP; Gregory M. Stone

(57) ABSTRACT

A toy racetrack has a variety of features allowing a user to control and effect the travel path of toy vehicles as they travel through the toy racetrack. One or more car feeders are provided as starting points for a toy vehicle that is to be introduced onto a continuous closed loop track. A manually adjustable handle is operatively connected to a toy vehicle release that extends into the path of the car feeder, which blocks a toy vehicle's path until a user deliberately lowers the release through movement of the handle. Movement of the handle in a first direction lowers the release while raising a trigger into the path of the car feeder, preventing additional cars from entering the closed loop track. Movement of the handle in a second direction lowers the release while keeping the trigger retracted, allowing all cars to enter the closed loop track.

16 Claims, 8 Drawing Sheets

(56) References Cited

U.S. PATENT DOCUMENTS 4,355,807 A * 10/1982 Prehodka ..... A63H 18/028 104/60
4,423,871 A * 1/1984 Mucaro ..... A63H 18/00 463/64
4,513,966 A * 4/1985 Mucaro ..... A63H 18/028 238/10 F
4,558,867 A * 12/1985 Hippely ..... A63H 18/028 273/412
4,661,080 A * 4/1987 Goldstein ..... A63H 18/028 463/58
5,174,569 A * 12/1992 Ngai ..... A63H 18/023 104/304
5,254,030 A * 10/1993 Ostendorff ..... A63H 17/008 273/129 S
5,299,969 A * 4/1994 Zaruba ..... A63H 18/028 238/10 C
5,542,668 A * 8/1996 Casale ..... A63H 18/028 463/59
6,216,600 B1 * 4/2001 Verret ..... A63H 18/028 248/237
6,676,480 B2 * 1/2004 Sheltman ..... A63H 18/02 446/431
7,549,906 B2 * 6/2009 Bedford ..... A63H 18/025 104/54
7,690,964 B2 * 4/2010 Nuttall ..... A63H 18/028 446/168
7,892,068 B2 * 2/2011 Nuttall ..... A63H 18/026 446/478
7,901,266 B2 * 3/2011 Ostendorff ..... A63H 18/04 104/53
7,946,903 B2 * 5/2011 Sheltman ..... A63H 18/06 446/168
8,011,994 B2 * 9/2011 Fink ..... A63H 18/026 446/168
8,176,852 B2 * 5/2012 O'Connor ..... A63H 18/028 104/53
8,342,903 B2 * 1/2013 O'Connor ..... A63H 18/028 446/444
8,382,553 B2 * 2/2013 O'Connor ..... A63H 18/02 446/444
8,430,712 B2 * 4/2013 O'Connor ..... A63H 18/08 446/444
8,567,690 B2 * 10/2013 De La Torre ..... A63H 18/06 446/444
8,574,023 B2 * 11/2013 Schmid ..... A63H 17/008 446/444
8,690,632 B2 * 4/2014 O'Connor ..... A63H 18/02 446/168
8,747,180 B2 * 6/2014 O'Connor ..... A63H 17/008 446/168
8,801,492 B2 * 8/2014 O'Connor ..... A63H 18/026 446/168
8,876,572 B2 * 11/2014 Martino ..... A63H 18/026 446/429
8,944,339 B2 * 2/2015 Ostendorff ..... A63H 18/026 238/10 E
9,314,703 B2 * 4/2016 Nuttall ..... A63H 18/02
9,314,704 B2 * 4/2016 Ostendorff ..... A63H 18/025
9,387,410 B1 * 7/2016 Tao ..... A63H 18/00
9,427,672 B2 * 8/2016 Picolet ..... A63H 18/00
9,573,071 B2 * 2/2017 Yu ..... A63H 18/028
9,586,154 B2 * 3/2017 Lau ..... A63H 18/14
10,213,702 B2 * 2/2019 Lennon ..... A63H 18/026
10,751,635 B2 * 8/2020 Payne ..... A63H 18/02
2005/0287915 A1 * 12/2005 Sheltman ..... A63H 18/028 446/444
2005/0287916 A1 * 12/2005 Sheltman ..... A63H 18/023 446/444
2005/0287919 A1 * 12/2005 Sheltman ..... A63H 18/028 446/444
2007/0049160 A1 * 3/2007 Matthes ..... A63H 18/02 446/444
2007/0293123 A1 * 12/2007 Nuttall ..... A63H 18/028 446/437
2008/0265048 A1 * 10/2008 O'Connor ..... A63H 18/026 238/10 E
2008/0268743 A1 * 10/2008 O'Connor ..... A63H 18/06 446/429

* cited by examiner

TOY VEHICLE PLAYSET WITH MANUALLY OPERABLE CAR FEEDER

CROSS REFERENCE TO RELATED APPLICATION

This application claims the benefit of U.S. Provisional Application No. 62/784,876 titled "Toy Vehicle Playset with Manually Operable Car Feeder," filed Dec. 26, 2018 by the inventor herein, which application is incorporated herein by reference in its entirety.

FIELD OF THE INVENTION

The present invention relates to toy vehicle playsets, and more particularly to a toy vehicle playset having manually operable toy vehicle feeders that feed one or more toy vehicles at a time into a continuous closed loop track, with manually operable toy vehicle path diverters, such as one or more jump ramps, positioned along the continuous closed loop track.

BACKGROUND

Toy vehicle playsets and racetracks are popular among children of varied ages, and a variety of track configurations have previously been provided that include various features to add to the excitement a child experiences while playing with the toy. For instance, toy vehicle playsets and racetracks have been provided having portions of the track that are moveable and that may change position with respect to other portions of the track during play, and that may change the position of a toy vehicle at differing locations along the track. Other toy vehicle playsets and racetracks have been provided having portions where track paths overlap, creating a so-called "crash zone" in which cars travelling along the path may crash into one another.

While certain prior configurations have provided changeable configurations of various toy racetrack elements during play, there remains an ongoing need to provide toy racetrack features capable of maintaining the interest of a child and increasing the excitement and amusement they experience when playing with a toy racetrack. It would therefore be advantageous to provide a toy racetrack with unique toy vehicle paths and positioning mechanisms to further enhance the excitement and amusement offered to a child as they engage in such play.

SUMMARY OF THE INVENTION

Disclosed is a toy racetrack having a variety of features that together allow a user to control and effect the travel path of toy vehicles as they travel through the toy race track. One or more car feeders are provided as starting points for a toy vehicle that is to be introduced onto a continuous closed loop track. A manually operable handle is operatively connected to a toy vehicle release that extends upward into the path of the car feeder, which release blocks a toy vehicle's path until a user deliberately lowers the release through movement of the handle. Movement of the handle in a first direction will lower the release while raising a trigger upward into the path of the car feeder, thus preventing additional toy vehicles from entering the closed loop track. One or more manually adjustable jump ramps are provided along the closed loop racetrack, which in a first, raised position allow a toy vehicle to travel along the flat portion of the racetrack below the jump ramp, and which in a second, lowered position allow a toy vehicle to enter the jump ramp and be launched toward a catch ramp positioned further along the path of the closed loop racetrack. When a toy vehicle enters the catch ramp with the proper alignment, catch ramp gates guide the toy vehicle back toward the surface of the closed loop racetrack. Portions of the racetrack are configured to allow folding overtop of other portions of the racetrack, thus allowing a user to reduce the footprint of the racetrack when not in use.

In accordance with certain aspects of an embodiment of the invention, a toy vehicle racetrack is provided comprising: a base; loop track portions attached to the base to form a continuous closed loop racetrack with intersecting track paths at the base; a car feeder track positioned to direct toy vehicles toward the base and having a starting switch configured to allow a user to selectively release one or multiple toy vehicles at a time from the car feeder track toward the base; and a manually operable toy vehicle jump ramp configured to allow a user to selectively cause a toy vehicle to either travel along a flat portion of the closed loop racetrack, or launch from the jump ramp through the air toward another portion of the closed loop racetrack.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
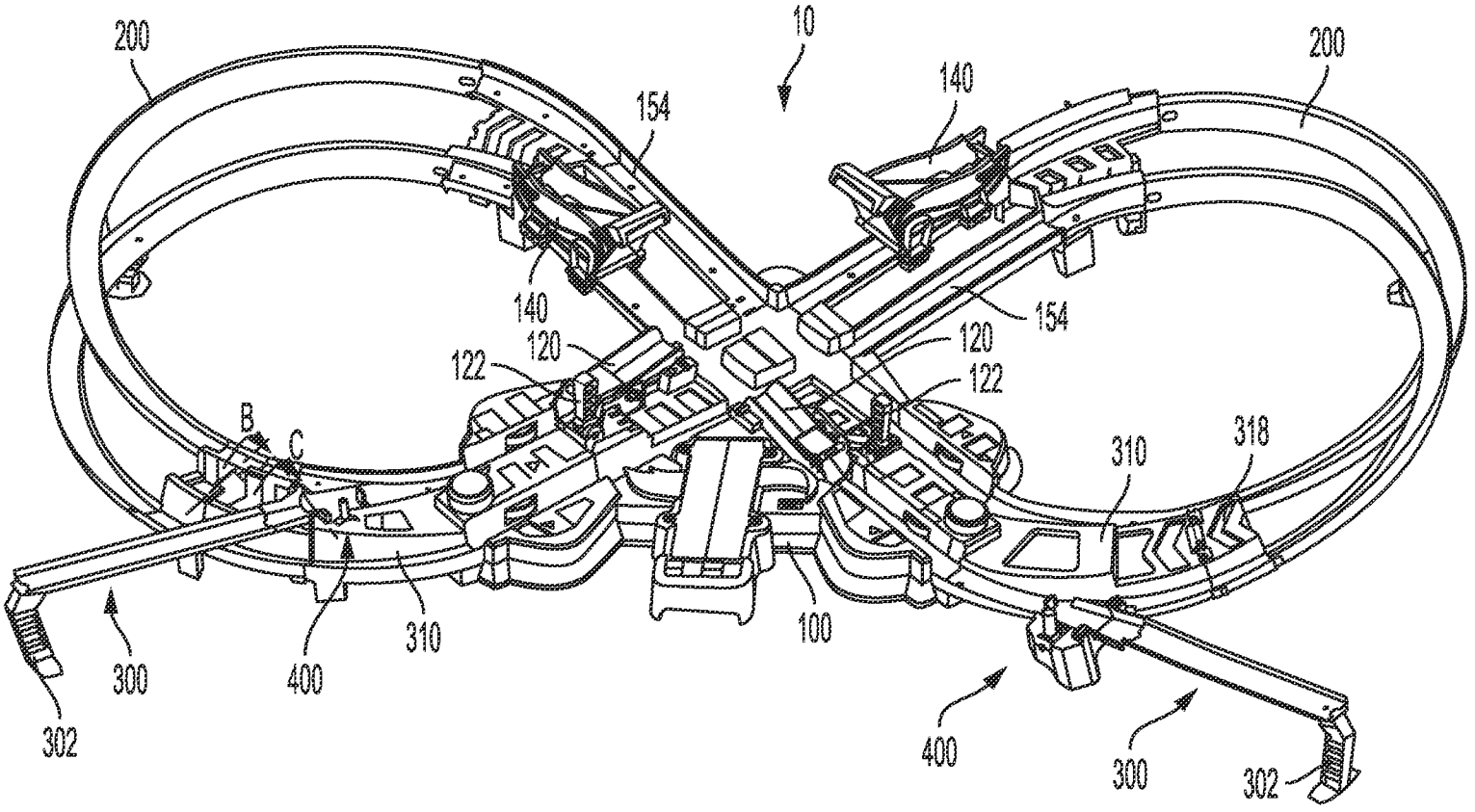
FIG. 1 is a perspective view of a toy vehicle racetrack in accordance with certain aspects of an embodiment of the invention.

In accordance with an embodiment of the invention and with reference to FIG. 1, a toy vehicle racetrack 10 is provided having a base 100 and loop track portions 200 that attach to base 100 to form a continuous closed loop racetrack. Paths of such continuous closed loop racetrack intersect at base 100, such that if toy vehicles travel through those intersecting portions of those paths at the same time, they will "crash" into one another, typically causing one or both of the toy vehicles to fly off of the track. As discussed in greater detail below, base 100 includes manually operable jump ramps 120 within each path of the continuous closed loop racetrack, which allow a user to have their vehicle either travel through the intersecting portions of those paths, and thus be exposed to possibly crash into another vehicle, or launch into the air along jump ramp 120. Moreover, to further add to the excitement and skill required to either cause or avoid such crashes, car feeder tracks 300 are provided and include a manually operable starting switch 400, which starting switch 400 allows a player to selectively release one or more toy vehicles at a time from car feeder tracks 300 into the closed loop racetrack.

Figure 2:
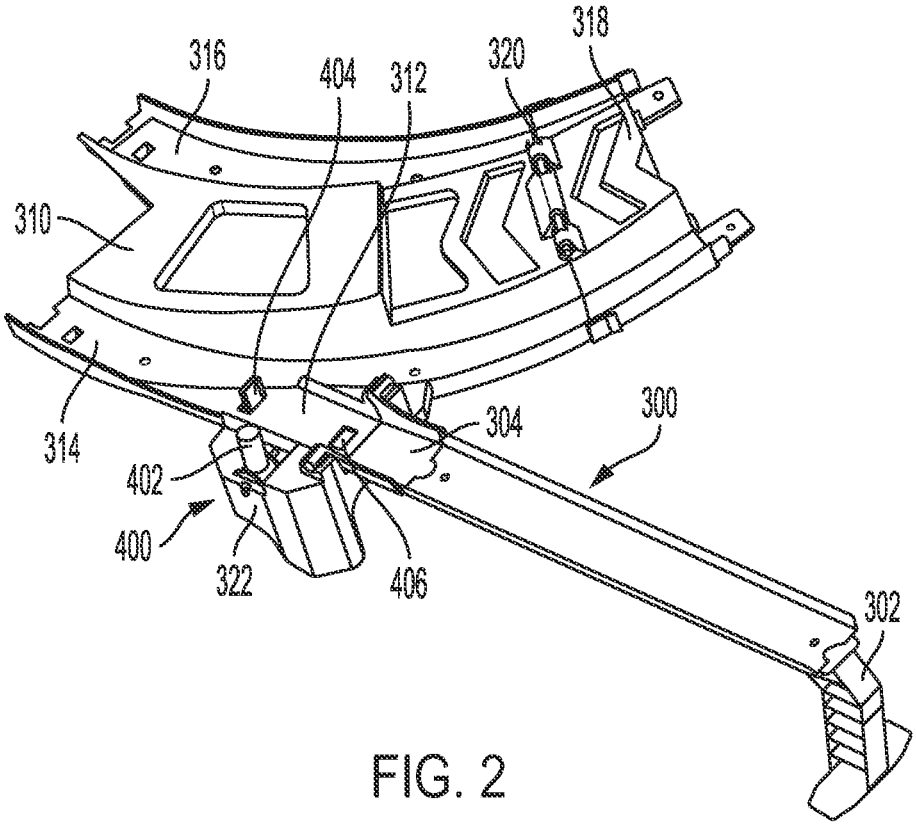
FIG. 2 is a perspective view of a start platform and car track feeder portion of the toy vehicle racetrack of FIG. 1.

FIG. 2 provides a close-up view of car feeder track 300 and starting switch 400. Car feeder track 300 is supported at one end by a car feeder stand 302, and is attached at its opposite end to start platform 310. Car feeder track 300 includes an entrance hinge 304, which pivotably attaches a plastic track span of car feeder track 300 to start platform 310. Start platform 310 includes a toy vehicle loading zone 312 that receives toy vehicles from car feeder track 300, a first toy vehicle track path portion 314 that receives toy vehicles from toy vehicle loading zone 312, and a second toy vehicle track path portion 316. As shown in FIG. 1, car feeder tracks 300 and starting switches 400 are provided on opposite sides of toy vehicle racetrack 10, each car feeder track positioned to direct toy vehicles into either first track path portion 314 or second track path portion 316.

With continuing reference to FIG. 2, start platform 310 also includes a starting switch housing 322 that houses starting switch 400. Starting switch 400 includes a manually operable starting switch handle 402 that pivots forward and backward to selectively lift and lower a toy vehicle release 404 and a starting switch trigger 406. More particularly, and as discussed in greater detail below, when a user pushes starting switch handle 402 forward and towards first track path portion 314, toy vehicle release 404 moves downward into starting switch housing 322, thus allowing a toy vehicle in toy vehicle loading zone 312 to enter first track path portion 314, while simultaneously lifting starting switch trigger 406 up from starting switch housing 322 and into the path of car feeder track 300 so as to block other toy vehicles on car feeder track 300 from entering the first track path portion 314. Alternatively, the user may pull starting switch handle 402 rearward and toward car feeder stand 302, which only moves toy vehicle release 404 downward into starting switch housing 322 while leaving starting switch trigger 406 retracted in starting switch housing 322, thus allowing all toy vehicles on car feeder track 300 to enter into first track path portion 314.

Figure 3:
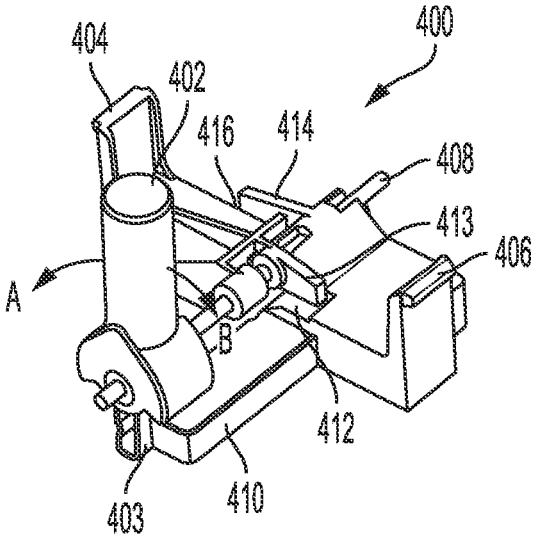
FIG. 3 is a close-up perspective view of a starting switch for use with the toy vehicle racetrack of FIG. 1.
Figure 4:
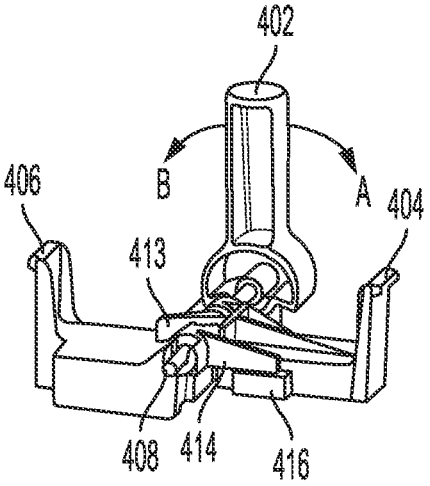
FIG. 4 is another close-up perspective view of the starting switch of FIG. 3.

FIGS. 3 and 4 are close-up views of the components that form starting switch 400. Starting switch handle 402 is attached to pivot pin 408, which pivot pin 408 is rotatably mounted in starting switch housing 322, such that starting switch handle 402 may pivot forward and backward with respect to starting switch housing 322. Likewise, each of toy vehicle release 404 and starting switch trigger 406 are pivotably attached to pivot pin 408. Starting switch handle 402 includes a tab 403 at its lower end, which tab 403 is positioned adjacent trigger arm 410, such that pushing starting switch handle 402 forward (in the direction of arrow A in FIG. 3), tab 403 pushes trigger arm 410 to cause starting switch trigger 406 to rotate about pivot pin 408 and extend through toy vehicle loading zone 312. A spring member (not shown) biases starting switch handle 402 to the upright position shown in the Figures, such that when starting switch handle 402 is released and returns to such center position, starting switch trigger 406 rotates back to its retracted position within starting switch housing 322 and out of the path of toy vehicle loading zone 312. Further, when starting switch trigger 406 is pivoted upwards, trigger lifting face 412 pushes against a release arm 413 on toy vehicle release 404 to pivot toy vehicle release 404 downward into starting switch housing 312 and out of the path of toy vehicle loading zone 312. As best shown in FIG. 4, starting switch trigger 406 also includes a trigger actuator arm 414 that engages a release actuator flange 416. When starting switch handle 402 is in the center, upright position shown in FIGS. 3 and 4, a portion of the bottom edge of trigger actuator arm 414 sits in contact with an upper surface of release actuator flange 416, thus holding toy vehicle release 404 in the extended position (i.e., extending through starting switch housing 322 into toy vehicle loading zone 312) shown in FIG. 4. When starting switch handle 402 is pivoted in the direction of arrow A, trigger actuator arm 414 also pushes on release actuator flange 416 to likewise cause toy vehicle release 404 to pivot downward. Further, when starting switch handle 402 is pivoted in the opposite direction (i.e., the direction of arrow B), starting switch trigger 406 pivots downward, causing trigger actuator arm 414 to disengage from release actuator flange 416, in turn allowing toy vehicle release 404 to again pivot downward. As starting switch handle 402 is then released to return (under spring bias) to the center, upright position, trigger actuator arm 414 comes back into contact with release actuator flange 416 to cause toy vehicle release 404 to pivot upward and back to its extended position shown in FIGS. 3 and 4.

Referring again to FIG. 1, toy vehicle racetrack 10 includes jump ramps 120 that pivot into and out of the path of travel of toy vehicles traveling along the continuous closed loop racetrack. Jump ramp handles 122 may be manipulated by a user to raise and lower jump ramps 120, thus allowing a toy vehicle to either stay on the flat portion of the racetrack, and thus pass under jump ramp 120, or to enter the jump ramp 120 and launch into the air toward a catch ramp 140 that is positioned on loop track portion 200.

Figure 5:
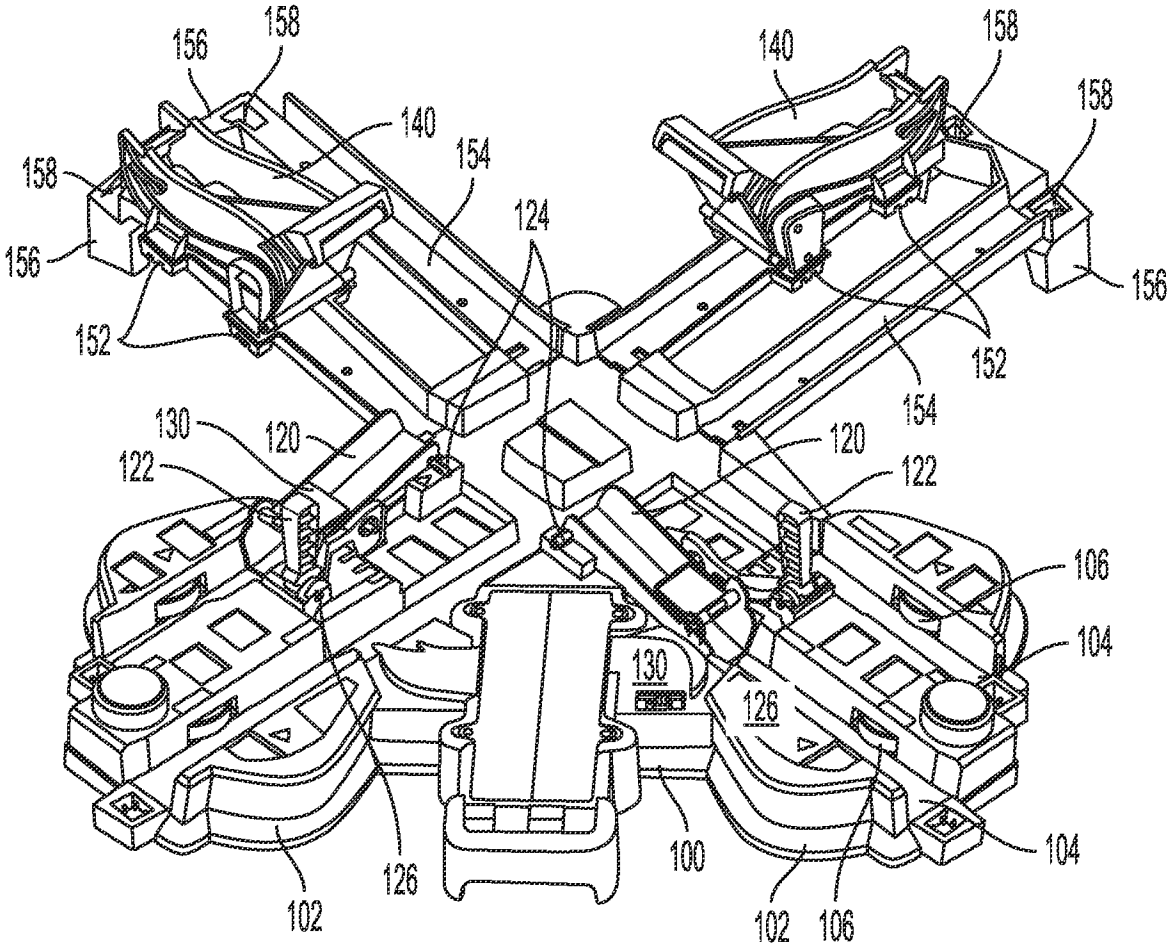
FIG. 5 is a perspective view of a base, booster units, and catch ramps of the toy vehicle racetrack of FIG. 1.
Figure 6:
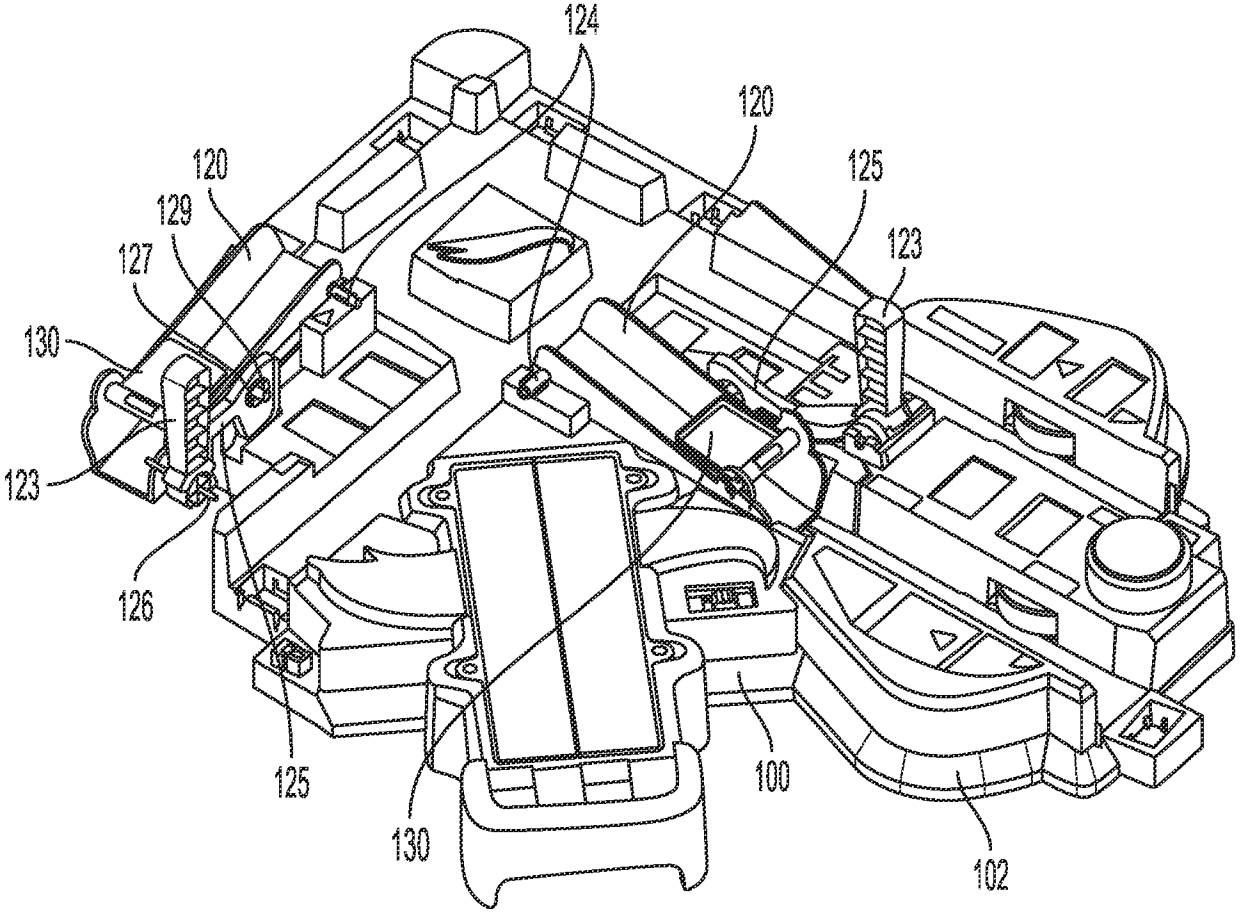
FIG. 6 is a close-up perspective view of the base of FIG. 5.

FIG. 5 is a close-up view of base 100 with jump ramps 120 and of each catch ramp 140. Base 100 includes booster units 102. Each booster unit has two toy vehicle travel lanes 104, and houses multiple motor-driven drive wheels 106 that propel toy vehicles through the booster unit. One such travel lane 104 on each booster unit 102 aligns with a jump ramp 120. Each jump ramp 120 is pivotably attached to base 100 at a pivot connection 124, which pivot connection 124 is positioned at the launch end of jump ramp 120. Each jump ramp handle 122 is likewise pivotably attached to base 100 at pivot connection 126. As shown in FIGS. 5 and 6, each jump ramp handle 122 includes an upstanding grip 123 and an actuator arm 125 having an opening 127 at its end that receives a lifting pin 129 extending outward from the side of jump ramp 120. Thus, as jump ramp handle 122 is pivoted about pivot connection 126, actuator arm 125 raises lifting pin 129, in turn causing jump ramp 120 to pivot upward about pivot connection 124, thus raising jump ramp 120 out of the path of a toy vehicle travelling through booster unit 102. Likewise, when jump ramp handle 122 is pivoted back to the position shown in FIGS. 5 and 6, actuator arm 125 lowers lifting pin 129, in turn causing jump rap 120 to pivot downward about pivot connection 124, thus lowering jump ramp 120 into the path of a toy vehicle travelling through booster unit 102. In such a lowered position, and as best viewed in FIG. 5, a toy vehicle that travels along jump ramp 120 is launched into the air toward catch ramp 140, as discussed further below. Jump ramp 120 may also include a gate 130 pivotably mounted to the interior walls of each jump ramp 120 at its entrance, which gate will swing upward when impacted by a toy vehicle travelling onto such jump ramp 120.

Figure 7:
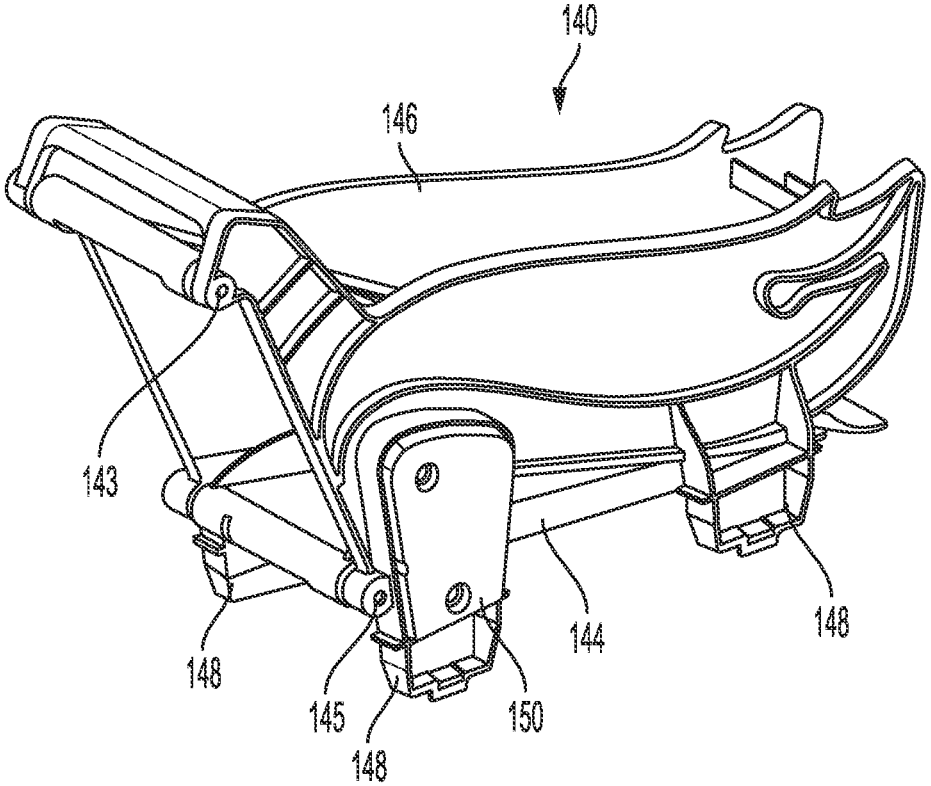
FIG. 7 is a close-up perspective view of a catch ramp of FIG. 5.
Figure 8:
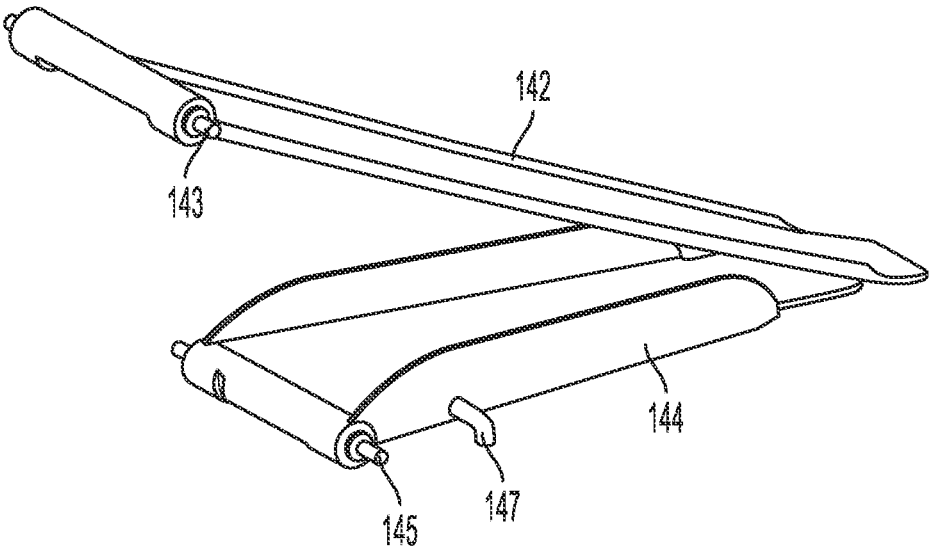
FIG. 8 is a component view of upper and lower catch ramp gates for use with the catch ramp of FIG. 7.

With continued reference to FIG. 5 and the close-up views of FIGS. 7 and 8, catch ramp 140 is aligned along toy vehicle racetrack 10 with jump ramp 120. When jump ramp 120 is raised and a toy vehicle passes under the jump ramp 120, such toy vehicle continues along the racetrack 10 towards catch ramp 140. Likewise, when jump ramp 120 is lowered and a toy vehicle travels onto the jump ramp 120, such toy vehicle launches into the air from the launching end of the jump ramp 120 and towards catch ramp 140.

Figure 9:
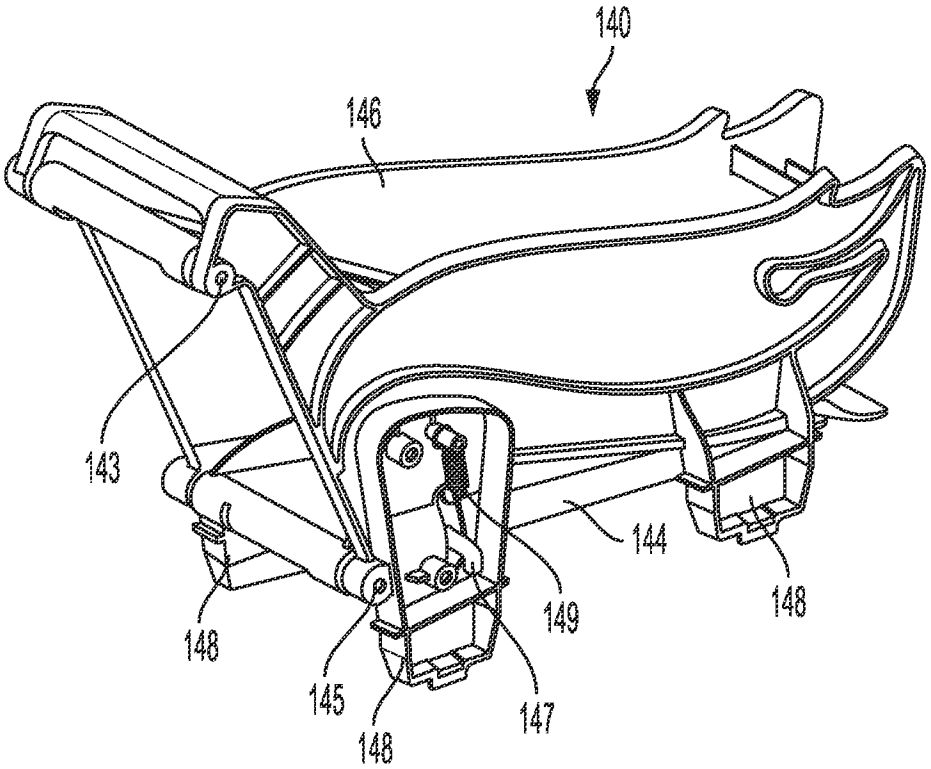
FIG. 9 is a close-up perspective view of the catch ramp of FIG. 5 showing a spring for upwardly biasing a lower catch ramp.

Catch ramp 140 includes an upper catch ramp gate 142 that is pivotably attached at hinge 143 to catch ramp housing 146. Likewise, catch ramp 140 includes a lower catch ramp gate 144 that is pivotably attached at hinge 145 to catch ramp housing 146. As shown in FIG. 9, lower catch ramp gate 144 is upwardly spring biased. More particularly, a spring receiver 147 extends outward from a sidewall of lower catch ramp gate 144 and through an opening in the side of catch ramp housing 146. A spring 149 is attached at one end to catch ramp housing 146, and at an opposite end to spring receiver 147. With such upward spring bias of lower catch ramp gate 144, a toy vehicle travelling along racetrack 10 underneath of catch ramp 140 will pass freely without interacting with catch ramp 140. However, in the event that a toy vehicle is launched from jump ramp 120 at an appropriate, user-controlled angle, such toy vehicle will enter into catch ramp 140 between upper catch ramp gate 142 and lower catch ramp gate 144. As the toy vehicle travels through catch ramp 140, it pushes upward on upper catch ramp gate 142 causing it to pivot upward about hinge 143, and pushes downward on lower catch ramp gate 144, lowering the opposite end of lower catch ramp gate 144 down to the surface of the racetrack 10 and allowing smooth transition of the toy vehicle back onto the racetrack 10. Catch ramp 140 includes feet 148 that allow catch ramp 140 to be connected to racetrack 10 at receivers 152 (FIG. 5) on catch ramp base 154.

Figure 10:
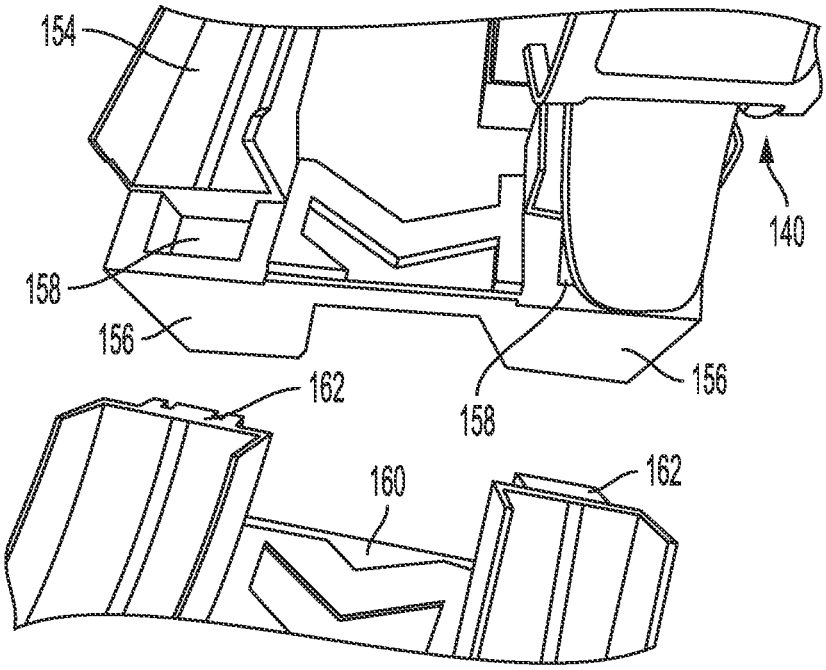
FIG. 10 is a top perspective view of a connection between a catch ramp base and a track connector of the toy vehicle racetrack of FIG. 1.
Figure 11:
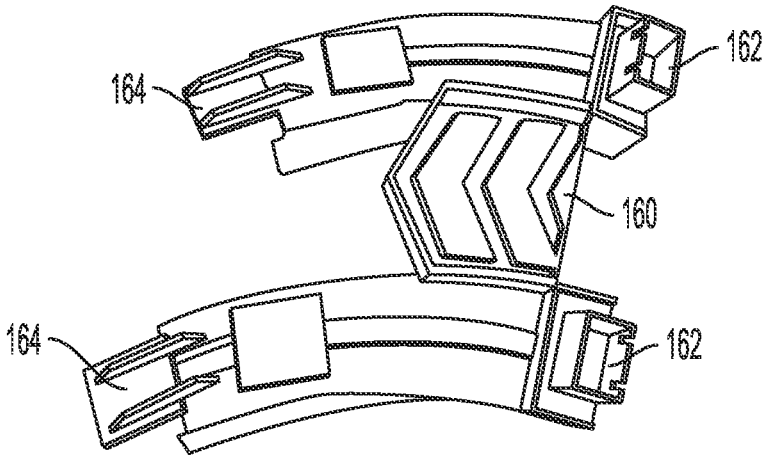
FIG. 11 is a bottom perspective view of the track connector of FIG. 10.
Figure 12:
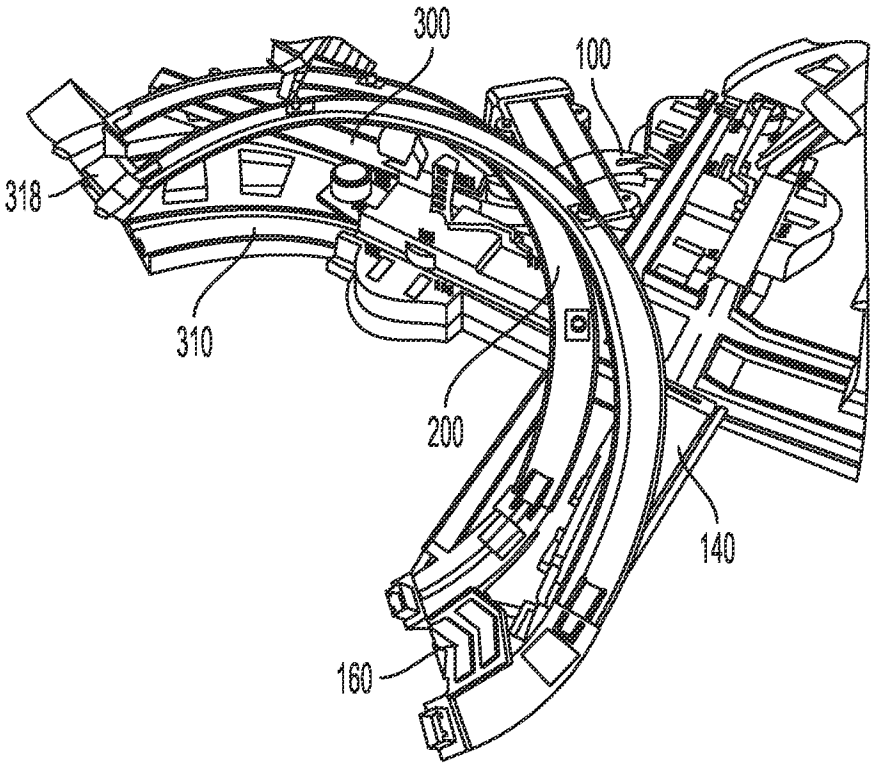
FIG. 12 is a perspective view of the toy vehicle racetrack of FIG. 1 in a partially folded condition for easy storage.

Toy racetrack 10 is also provided with features allowing the racetrack 10 to be folded into a compact configuration for ease of storage when not in use. As shown in FIG. 5, catch ramp 140 is attached to catch ramp base 154, which in turn is attached at a first end to base 100. The opposite end of catch ramp base 154 includes legs 156, each of which includes a socket 158. A track connector 160 (FIGS. 10 and 11) serves to connect catch ramp base 154 to loop track portion 200, and includes tabs 162 configured to releasably connect with sockets 158 in legs 156 of catch ramp base 154, such as by way of non-limiting example a snap-fit connection. The end of track connector 160 opposite legs 156 includes track receivers 164 configured to receive sections of plastic, semi-flexible track of known configuration that form loop track portion 200. The opposite ends of track forming loop track portion 200 are attached to the end of start platform 310 that is opposite to base 100. As shown in FIG. 2, that track-engaging end of start platform 310 includes a start platform hinged section 318 that is pivotably attached to the rest of start platform 310 at hinge 320. Thus, as shown in FIG. 12, when track connector 160 is detached from catch ramp base 154, the entire loop track portion 200 may be pivoted about hinge 320 in the direction of arrow B in FIG. 1, folding loop track portion 200 overtop of base 100. Likewise, each car feeder track 300 may be pivoted at entrance hinge 304 (FIG. 2) in the direction of arrow C in FIG. 1, folding each car feeder track 300 overtop of base 100. With such elements of toy vehicle racetrack 10 folded toward base 100, the footprint of toy vehicle racetrack 10 is substantially reduced, thus easing storage when the racetrack is not in use.

A toy vehicle racetrack configured in accordance with the foregoing features offers increased excitement and challenge during play by providing a manually operable car feeder mechanism that allows the user to selectively release one or multiple toy vehicles into a crash zone and on to a continuous closed loop racetrack. Once in the path of the racetrack, the user may modify the path of the toy vehicles by manually positioning a jump ramp to either allow the toy car to continue along the flat path of the track, or alternatively launch from the jump ramp over the crash zone and in an attempt to have the toy vehicle caught within a separate catch ramp, from which it may continue its path along the track. Further, the toy racetrack may be folded to a compact size for easy storage.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A toy vehicle racetrack comprising:

a base;

loop track portions attached to said base to form a continuous closed loop racetrack with intersecting track paths at said base;

a car feeder track positioned to direct toy vehicles toward said base and having a starting switch configured to allow a user to selectively release one or multiple toy vehicles at a time from said car feeder track toward said base;

a manually operable toy vehicle jump ramp configured to allow a user to selectively cause a toy vehicle to either travel along a flat portion of said closed loop racetrack, or launch from said jump ramp through air toward another portion of said closed loop racetrack; and a catch ramp on said continuous closed loop racetrack and aligned along said toy vehicle racetrack with said toy vehicle jump ramp, said catch ramp further comprising an upper catch ramp gate pivotably attached to said catch ramp at an entrance end of said catch ramp, and a lower catch ramp gate pivotably attached to said catch ramp at said entrance end of said catch ramp, and defining a space between said upper catch ramp and said lower catch ramp sized to receive therein a toy vehicle launched from said jump ramp.

2. The toy vehicle racetrack of claim 1, wherein said lower catch ramp gate is upwardly spring biased.

3. The toy vehicle racetrack of claim 1, said jump ramp having a toy vehicle entrance end and a toy vehicle launching end, wherein said jump ramp is pivotably connected to said base at said toy vehicle launching end of said jump ramp.

4. The toy vehicle racetrack of claim 3, wherein said jump ramp is pivotable from a first position in which said toy vehicle entrance end is in contact with said flat portion of said closed loop racetrack to a second position in which said toy vehicle entrance is positioned above said flat portion of said closed loop racetrack by a sufficient distance to allow a toy vehicle to pass underneath of said jump ramp.

5. The toy vehicle racetrack of claim 1, wherein at least a portion of said continuous closed loop racetrack is pivotable onto said base to reduce a footprint of said toy vehicle racetrack.

6. The toy vehicle racetrack of claim 1, wherein at least a portion of said car feeder track is pivotable onto said base to reduce a footprint of said toy vehicle racetrack.

7. The toy vehicle racetrack of claim 1, said starting switch further comprising a manually operable handle, a starting switch trigger extendable through said car feeder track a sufficient distance to block toy vehicles from travelling from said car feeder track to said base, and a toy vehicle release extendable through said car feeder track a sufficient distance to block toy vehicles from travelling from said car feeder track to said base.

8. The toy vehicle racetrack of claim 7, wherein said toy vehicle release is positioned between said starting switch trigger and said base.

9. The toy vehicle racetrack of claim 7, wherein movement of said handle in a first direction retracts said toy vehicle release while upwardly extending said starting switch trigger.

10. The toy vehicle racetrack of claim 9, wherein movement of said handle in a second direction opposite said first direction retracts said toy vehicle release while maintaining said starting switch trigger in a downward, retracted position.

11. A toy vehicle racetrack comprising:

a base;

loop track portions attached to said base to form a continuous closed loop racetrack with intersecting track paths at said base;

a manually operable starting switch configured to allow a user to selectively release at least one toy vehicle onto said continuous closed loop racetrack;

a manually operable toy vehicle jump ramp configured to allow a user to selectively cause a toy vehicle to either travel along a flat portion of said closed loop racetrack, or launch from said jump ramp through air toward another portion of said closed loop racetrack; and a catch ramp on said continuous closed loop racetrack and aligned along said toy vehicle racetrack with said toy vehicle jump ramp, said catch ramp further comprising a catch ramp gate pivotably attached to said catch ramp at an entrance end of said catch ramp, wherein said catch ramp is pivotable from (i) a first position in which an exit end of said catch ramp is positioned above said continuous closed loop racetrack by a sufficient distance to allow a toy vehicle on said continuous closed loop racetrack to pass beneath said catch ramp, to (ii) a second position in which said exit end of said catch ramp is in contact with said continuous closed loop racetrack.

12. The toy vehicle racetrack of claim 11, said jump ramp having a toy vehicle entrance end and a toy vehicle launching end, wherein said jump ramp is pivotably connected at said base at said toy vehicle launching end of said jump ramp.

13. The toy vehicle racetrack of claim 12, wherein said jump ramp is pivotable from a first position in which said toy vehicle entrance end is in contact with said flat portion of said closed loop racetrack to a second position in which said toy vehicle entrance is positioned above said flat portion of said closed loop racetrack by a sufficient distance to allow a toy vehicle to pass underneath of said jump ramp.

14. The toy vehicle racetrack of claim 11, wherein at least a portion of said continuous closed loop racetrack is pivotable onto said base to reduce a footprint of said toy vehicle racetrack.

15. The toy vehicle racetrack of claim 11, further comprising a car feeder track positioned to direct toy vehicles toward said base, wherein at least a portion of said car feeder track is pivotable onto said base to reduce a footprint of said toy vehicle racetrack.

16. A toy vehicle racetrack comprising:

a base;

loop track portions attached to said base to form a continuous closed loop racetrack with intersecting track paths at said base;

a manually operable starting switch configured to allow a user to selectively release at least one toy vehicle onto said continuous closed loop racetrack;

a manually operable toy vehicle jump ramp configured to allow a user to selectively cause a toy vehicle to either travel along a flat portion of said closed loop racetrack, or launch from said jump ramp through air toward another portion of said closed loop racetrack; and a car feeder track positioned to direct toy vehicles toward said base, and said starting switch further comprising a manually operable handle, a starting switch trigger extendable through said car feeder track a sufficient distance to block toy vehicles from travelling from said car feeder track to said base, and a toy vehicle release extendable through said car feeder track a sufficient distance to block toy vehicles from travelling from said car feeder track to said base.

* * * * *